US011104139B2

(12) United States Patent
Tsuchiya

(10) Patent No.: US 11,104,139 B2
(45) Date of Patent: Aug. 31, 2021

(54) MAINTENANCE UNIT AND INKJET PRINTER

(71) Applicant: MIMAKI ENGINEERING CO., LTD., Nagano (JP)

(72) Inventor: Takashi Tsuchiya, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 41 days.

(21) Appl. No.: 16/822,017

(22) Filed: Mar. 18, 2020

(65) Prior Publication Data

US 2020/0298553 A1 Sep. 24, 2020

(30) Foreign Application Priority Data

Mar. 19, 2019 (JP) ..... JP2019-050768

(51) Int. Cl.
*B41J 2/165* (2006.01)

(52) U.S. Cl.
CPC ..... *B41J 2/16508* (2013.01)

(58) Field of Classification Search
CPC ..... B41J 2/16508
See application file for complete search history.

(56) References Cited

U.S. PATENT DOCUMENTS

2005/0168518 A1* 8/2005 Nishino ..... B41J 11/00214 347/29

FOREIGN PATENT DOCUMENTS

JP 2009248432 10/2009

* cited by examiner

*Primary Examiner* — Justin Seo
(74) *Attorney, Agent, or Firm* — JCIPRNET

(57) ABSTRACT

A maintenance unit includes a fixed-side cover in which multiple first openings are formed and a movable-side cover in which multiple second openings are formed. A moving mechanism slides the movable-side cover with respect to the fixed-side cover in a Y direction between a closed position where the second opening is disposed between multiple first openings in the Y direction and the movable-side cover closes the first openings, and an open position where the first opening and the second opening adjacent to each other at the closed position are overlapped in the vertical direction and an entire of multiple ink receiving portions are exposed.

15 Claims, 6 Drawing Sheets

MAINTENANCE UNIT AND INKJET PRINTER

CROSS REFERENCE TO RELATED APPLICATIONS

This application claims the priority benefit of Japanese Patent Application No. 2019-050768, filed on Mar. 19, 2019. The entirety of the above-mentioned patent application is hereby incorporated by reference herein and made a part of this specification.

TECHNICAL FIELD

The present disclosure relates to a maintenance unit provided for preventing clogging of nozzles of an inkjet head. The present disclosure also relates to an inkjet printer equipped with such a maintenance unit.

DESCRIPTION OF THE BACKGROUND ART

Conventionally, an inkjet printer including a plurality of inkjet heads (printer heads) that eject ink droplets, a carriage on which the plurality of inkjet heads are mounted, and a maintenance unit that is provided to prevent clogging of nozzles of the inkjet head is known (see, e.g., Japanese Unexamined Patent Publication No. 2009-248432, i.e., Patent Literature 1). In the inkjet printer described in Japanese Unexamined Patent Publication No. 2009-248432, the maintenance unit includes a plurality of head caps that cover and seal the nozzle surface of the inkjet head in which a plurality of nozzles is arranged.

In the inkjet printer described in Japanese Patent Application Laid-Open No. 2009-248432, for example, four inkjet heads are mounted on a carriage, and the maintenance unit includes four head caps for covering the nozzle surfaces of the four inkjet heads. The four inkjet heads and the four head caps are arranged at a constant interval in the main scanning direction. One end of an ink discharge pipe is connected to the bottom surface of the head cap. One end of the ink discharge pipe communicates with the internal space of the head cap. The other end of the ink discharge pipe is connected to a waste ink tank. A suction pump is disposed in the middle of the ink discharge pipe.

In the inkjet printer described in Japanese Unexamined Patent Publication No. 2009-248432, in order to prevent clogging of the nozzles of the inkjet head, the carriage is moved to the maintenance unit at a predetermined timing before starting printing of the print medium or during printing of the print medium, the nozzle surface of the inkjet head is covered and sealed by the head cap, and the suction pump is operated with the nozzle surface sealed to suction ink from the nozzles of the inkjet head. The ink suctioned by the suction pump flows from the head cap toward the waste ink tank. The head cap has a function of sealing the nozzle surface and a function of receiving ink suctioned by the suction pump and flowed out of the nozzle.

Patent Literature 1: Japanese Unexamined Patent Publication No. 2009-248432

SUMMARY

In the inkjet printer described in Japanese Unexamined Patent Publication No. 2009-248432, if the maintenance unit does not have a carriage during printing of a print medium, and the like, light may hit the head cap from the upper side of the head cap. Furthermore, in the inkjet printer described in Japanese Unexamined Patent Publication No. 2009-248432, ultraviolet curable UV ink may be used. It has been cleared by the review of the inventors of the present application that when UV ink is used in the inkjet printer described in Japanese Unexamined Patent Publication No. 2009-248432, if there is no carriage in the maintenance unit and light hits the head cap, the ink remaining in the internal space of the head cap cures and the ink is less likely to flow toward the waste ink tank. Furthermore, according to the review by the inventors of the present application, it is clear that when the light hits the head cap, the ink attached to the upper end portion of the head cap cures and the nozzle surface is hardly sealed by the head cap.

The inventors of the present application considered arranging a cover on the upper side of the head cap and covering the upper surface side of the head cap with the cover in order to prevent light from hitting the head cap when the maintenance unit has no carriage. In this case, when the carriage is moved to the maintenance unit and ink is suctioned from the nozzles of the inkjet head by the head cap, it is necessary to retract the cover from the upper side of the head cap and open the upper side of the head cap.

When the cover covering the upper surface side of the head cap is retracted from the upper side of the head cap and the upper side of the head cap is opened, a large space for retracting the cover is required if the moving distance (retracting distance) of the cover becomes long. Furthermore, as the time taken to retract the cover becomes longer as the moving distance of the cover becomes longer, when ink is suctioned from the nozzles of the inkjet head at a predetermined timing before starting printing of the print medium or during printing of the print medium, it takes time until sealing the nozzle surface with the head cap, and as a result, the printing time of the print medium becomes longer.

Thus, the present disclosure provides a maintenance unit, which is provided to prevent clogging of the nozzles of the inkjet head, that can short the moving distance of the cover when opening the upper side of the ink receiving portion even if the upper surface side of a plurality of ink receiving portions for receiving ink flowing out from the nozzles of the inkjet head can be covered with a cover. The present disclosure also provides an inkjet printer equipped with such a maintenance unit.

In order to solve the above problems, a maintenance unit of the present disclosure is provided. The maintenance unit is provided to prevent clogging of nozzles of an inkjet head, and the maintenance unit includes: a plurality of ink receiving portions for receiving ink flowing out from the nozzles on a lower side of a nozzle surface of the inkjet head in which a plurality of the nozzles is arranged; a fixed-side cover disposed on an upper side of the plurality of ink receiving portions to cover an upper surface side of the plurality of ink receiving portions; a movable-side cover disposed in a state of overlapping the fixed-side cover on the upper side of the plurality of ink receiving portions to cover the upper surface side of the plurality of ink receiving portions and disposed to be slidable with respect to the fixed-side cover; and a moving mechanism that slides the movable-side cover with respect to the fixed-side cover, where one direction in a horizontal direction is set as a first direction, at least two of the ink receiving portions are arranged at an interval of greater than or equal to a width of the first direction of the ink receiving portion in the first direction, the fixed-side cover is provided with a plurality of first openings that penetrate the fixed-side cover in a vertical direction and are disposed on the upper sides of each of the plurality of ink receiving portions, the movable-side cover is provided with a plurality of second openings that penetrate the movable-side cover in the vertical direction and is capable of being disposed on the upper side of each of the plurality of ink receiving portions, the first opening is provided with a size that an entire of the ink receiving portion is exposed when viewed from the upper side, the second opening is provided with a size that an entire of the ink receiving portion is exposed when viewed from the upper side in a state where the second opening is disposed on the upper side of the ink receiving portion, a width in the first direction of the second opening is less than or equal to the interval in the first direction of the plurality of first openings, a width in the first direction of the first opening is less than or equal to the interval in the first direction of the plurality of second openings, and the moving mechanism slides the movable-side cover in the first direction between a closed position and an open position, the closed position is a position where at least one of the second opening is disposed between the plurality of first openings in the first direction and the movable-side cover closes the plurality of first openings, and the open position is a position where the first opening and the second opening adjacent in the first direction at the closed position are overlapped in the vertical direction and an entire of the plurality of ink receiving portions are exposed when viewed from the upper side.

The maintenance unit of the present disclosure includes the fixed-side cover disposed on the upper side of each of the plurality of ink receiving portions and provided with the plurality of first openings, and the movable-side cover with a plurality of second openings that can be disposed on the upper side of each of the plurality of ink receiving portions. In the present disclosure, the moving mechanism slides the movable-side cover in the first direction between a closed position where at least one second opening is disposed between the plurality of first openings in the first direction and the movable-side cover closes the plurality of first openings, and an open position where the first opening and the second opening adjacent in the first direction at the closed position are overlapped in the vertical direction and the entire plurality of ink receiving portions are exposed when viewed from the upper side.

That is, in the present disclosure, the movable-side cover is slid to one side of the first direction to a position where the first opening and the second opening adjacent in the first direction at the closed position overlap in the vertical direction to open the upper side of the ink receiving portion covered by the movable-side cover. Therefore, in the present disclosure, even if the upper surface side of the ink receiving portion can be covered with the fixed-side cover and the movable-side cover, the moving distance of the movable-side cover when opening the upper side of the ink receiving portion can be shortened.

In the present disclosure, for example, a shape of the ink receiving portion when viewed from the upper side is a rectangular shape or a square shape, and a direction parallel to one side of the ink receiving portion having a rectangular shape or a square shape is the first direction. In this case, for example, a shape of the ink receiving portion when viewed from the upper side is a rectangular shape, and a direction parallel to a short side of the ink receiving portion having a rectangular shape is the first direction.

In the present disclosure, preferably, the first opening and the second opening are formed in a rectangular shape, and a short side of the first opening formed in a rectangular shape and a short side of the second opening formed in a rectangular shape are disposed to be parallel to the first direction. With this configuration, the moving distance of the movable-side cover when opening the upper side of the ink receiving portion can be shortened compared to a case where the long side of the first opening and the long side of the second opening are arranged parallel to the first direction. Therefore, the moving distance of the movable-side cover when opening the upper side of the ink receiving portion can be further shortened.

In the present disclosure, the fixed-side cover and the movable-side cover are preferably provided in a flat plate shape. With this configuration, the configuration of the fixed-side cover and the movable-side cover can be simplified, and the maintenance unit can be thinned in the vertical direction.

In the present disclosure, preferably, the width in the first direction of the first opening is narrower than the interval in the first direction of the plurality of second openings, and the width in the first direction of the second opening is narrower than the interval in the first direction of the plurality of first openings. With this configuration, the plurality of first openings can be reliably closed by the movable-side cover when the movable-side cover is disposed at the closed position.

In the present disclosure, a direction orthogonal to the vertical direction and the first direction is set as a second direction, at least two of the ink receiving portions are disposed at an interval narrower than a width in the second direction of the ink receiving portion in the second direction and disposed at the same position in the first direction, and the least two of the ink receiving portions are disposed at at least two locations at an interval of greater than or equal to the width in the first direction of the ink receiving portion in the first direction.

The maintenance unit of the present disclosure can be used in an inkjet printer including a plurality of inkjet heads that eject ink droplets, a carriage on which the plurality of inkjet heads is mounted, and a carriage moving mechanism that moves the carriage in a main scanning direction. In such an inkjet printer, even if the upper surface side of the ink receiving portion can be covered with the fixed-side cover and the movable-side cover, the moving distance of the movable-side cover when opening the upper side of the ink receiving portion can be shortened.

In the present disclosure, the moving mechanism preferably slides the movable-side cover in the main scanning direction. With this configuration, the maintenance unit can be miniaturized in the sub scanning direction orthogonal to the vertical direction and the main scanning direction.

Therefore, in the present disclosure, even if the upper surface side of the plurality of ink receiving portions for receiving ink flowing out from the nozzles of the inkjet head can be covered with the cover, the moving distance of the cover when opening the upper side of the ink receiving portion can be shortened.

DESCRIPTION OF EMBODIMENTS

Hereinafter, an embodiment of the present disclosure will be described with reference to the drawings.

(Schematic Configuration of Inkjet Printer)

Figure 1:
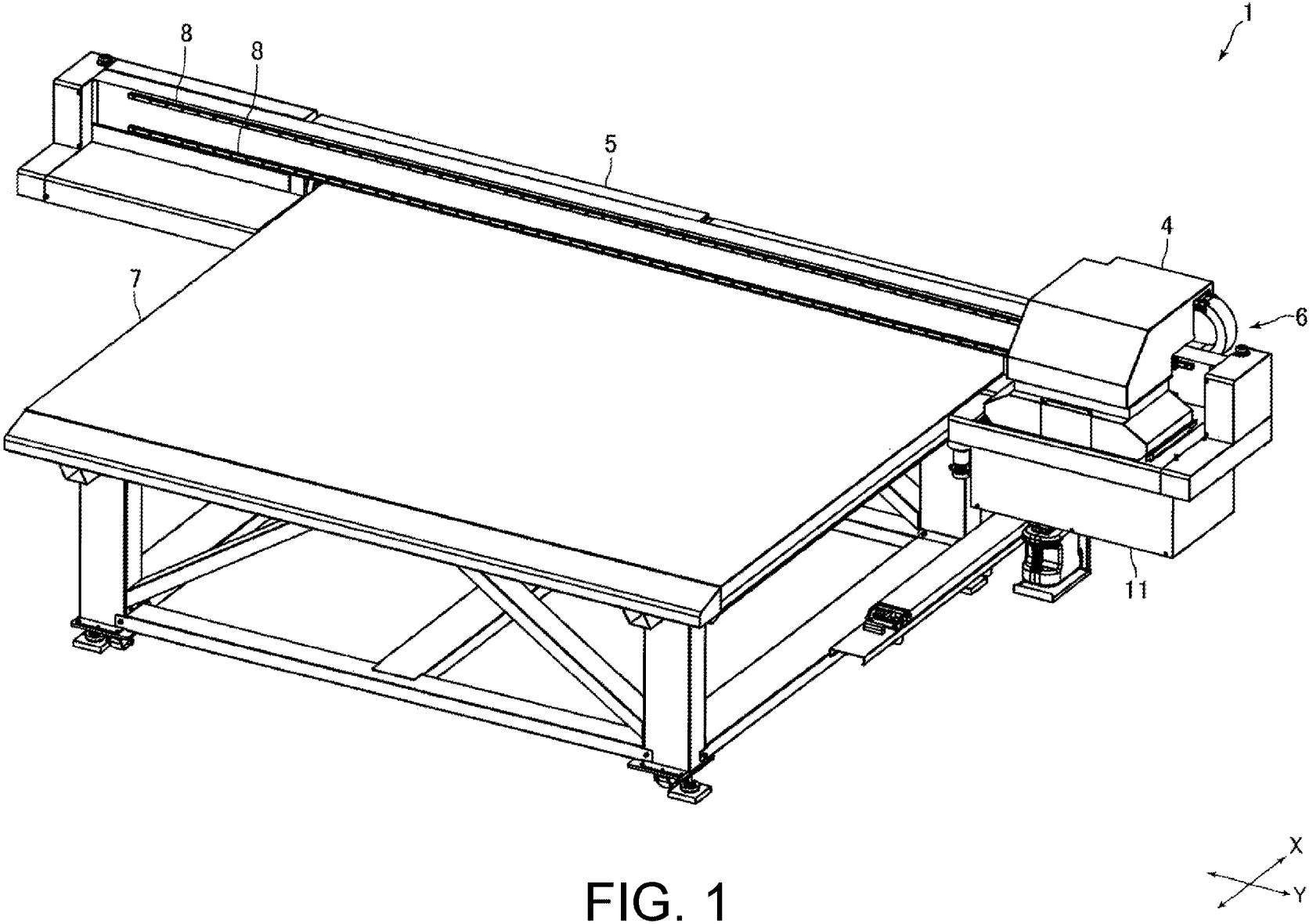
FIG. 1 is a perspective view of an inkjet printer according to an embodiment of the present disclosure.
Figure 2:
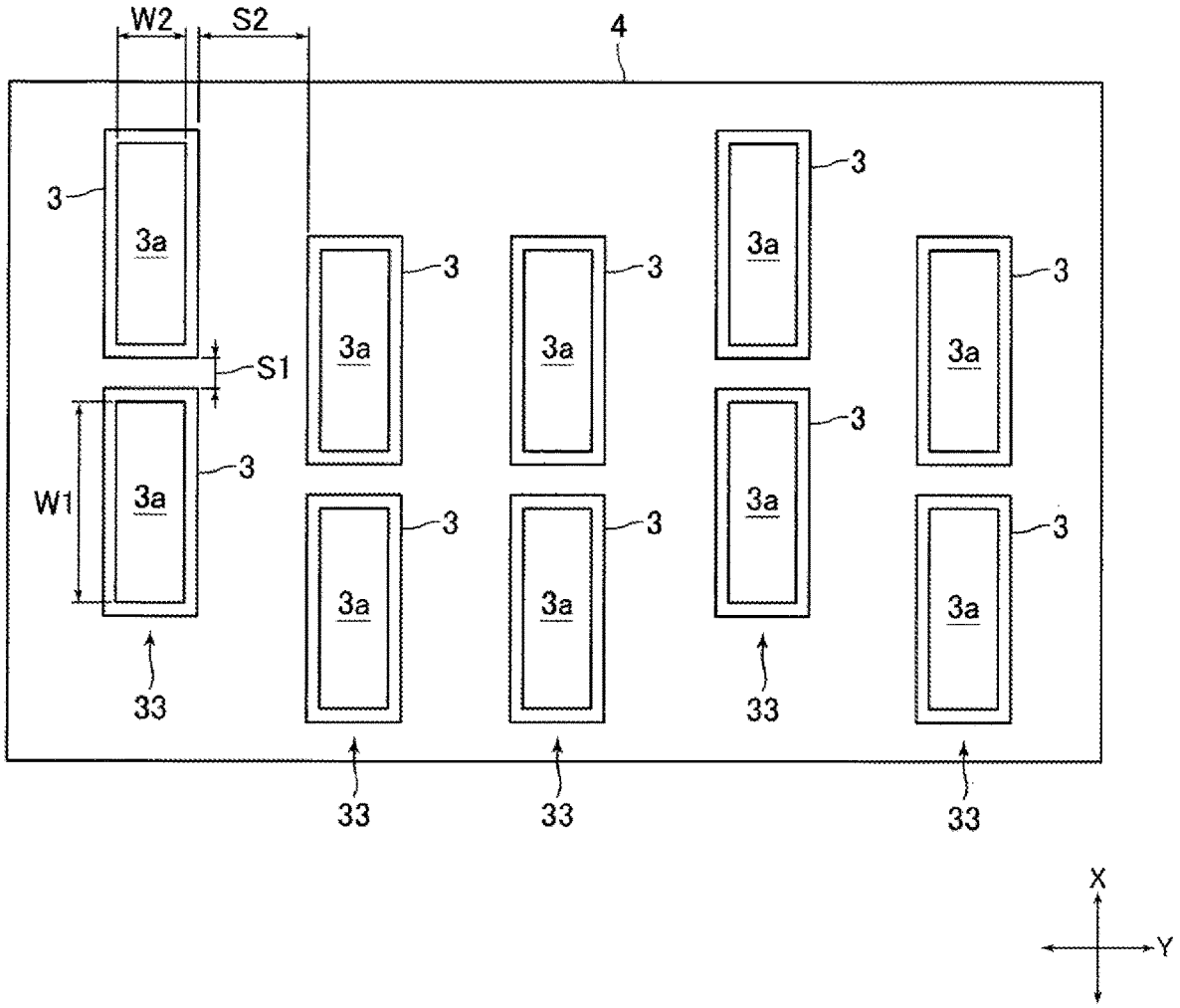
FIG. 2 is a bottom view for explaining the arrangement of inkjet head mounted on the carriage shown in FIG. 1.

FIG. 1 is a perspective view of an inkjet printer 1 according to an embodiment of the present disclosure. FIG. 2 is a bottom view for explaining the arrangement of an inkjet head 3 mounted on a carriage 4 shown in FIG. 1.

The inkjet printer 1 (hereinafter referred to as "printer 1") of the present embodiment is, for example, a business inkjet printer that performs printing on a print medium such as print paper. The printer 1 of the present embodiment is a so-called flat bed type inkjet printer. The printer 1 includes a plurality of inkjet heads 3 (hereinafter referred to as "heads 3") that eject ink droplets onto a print medium, and a carriage 4 on which the plurality of heads 3 are mounted. The printer 1 of the present embodiment includes ten heads 3 and the ten heads 3 are mounted on the carriage 4.

The printer 1 also includes a Y bar 5 that holds the carriage 4 so as to be movable in the main scanning direction, a carriage moving mechanism 6 that moves the carriage 4 in the main scanning direction with respect to the Y bar 5, a table 7 on which the print medium is placed, and a slide mechanism for sliding the Y bar 5 with respect to the table 7 in the sub scanning direction orthogonal to the vertical direction and the main scanning direction. In the following description, the main scanning direction (Y direction in FIG. 1 etc.) is assumed as "left-right direction" and the sub scanning direction (X direction in FIG. 1 etc.) is assumed as "front-back direction". The left-right direction (Y direction) of the present embodiment is a first direction, which is one direction in a horizontal direction. The front-back direction (X direction) is a second direction orthogonal to the vertical direction and the first direction.

The carriage 4 is disposed on the upper side of the table 7. The head 3 ejects ink droplets from the upper side toward the print medium placed on the upper surface of the table 7. A nozzle surface (ink ejection surface) 3*a* in which a plurality of nozzles that eject ink droplets are arrayed is formed on a lower surface of the head 3. The nozzle surface 3*a* is formed in a rectangular shape. The head 3 is mounted on the carriage 4 so that the long side of the nozzle surface 3*a* is parallel to the front-back direction (that is, the short side of the nozzle surface 3*a* is parallel to the left-right direction).

As described above, ten heads 3 are mounted on the carriage 4. Specifically, as shown in FIG. 2, two heads 3 that are arranged at a constant interval in the front-back direction and are arranged at the same position in the left-right direction are arranged at five places at a constant interval in the left-right direction. When two heads 3 arranged at the same position in the left-right direction are referred to as a head set 33, the interval S1 in the front-back direction between the two heads 3 forming the head set 33 is narrower than the width in the front-back direction of the nozzle surface 3*a* (length of the long side of the nozzle surface 3*a* formed in the rectangular shape) W1.

An interval S2 in the left-right direction of the five head sets 33 is wider than the width in the left-right direction of the nozzle surface 3*a* (length of the short side of the nozzle surface 3*a* formed in a rectangular shape) W2. Of the five head sets 33, three head sets 33 are arranged at the same position in the front-back direction. The remaining two head sets 33 are arranged at the same position in the front-back direction and are arranged at positions shifted from the three head sets 33. The amount of misalignment in the front-back direction between the three head sets 33 disposed at the same position in the front-back direction and the remaining two head sets 33 disposed at the same position in the front-back direction is smaller than the width W1 in the front-back direction of the nozzle surface 3*a*.

The ink ejected from the head 3 is an ultraviolet curable UV ink. The carriage 4 is equipped with an ultraviolet irradiator that irradiates the ink ejected from the head 3 with ultraviolet rays. The carriage moving mechanism 6 includes, for example, a motor, a driving pulley that is rotated by the power of the motor, a driven pulley, and a belt applied across the driving pulley and the driven pulley. A part of the belt is fixed to the carriage 4. The Y bar 5 is formed in a rectangular parallelepiped shape elongated in the left-right direction. A guide rail 8 for guiding the carriage 4 in the left-right direction (main scanning direction) is fixed to the Y bar 5. The slide mechanism includes, for example, a motor, a ball screw, and the like.

Furthermore, the printer 1 includes a maintenance unit 11 provided to prevent clogging (clogging) of the nozzles of the head 3. The maintenance unit 11 is disposed at a predetermined standby position of the carriage 4 which is a position deviated from a printing region of the print medium in the left-right direction (main scanning direction). Hereinafter, the configuration of the maintenance unit 11 will be described.

(Configuration of Maintenance Unit)

Figure 3:
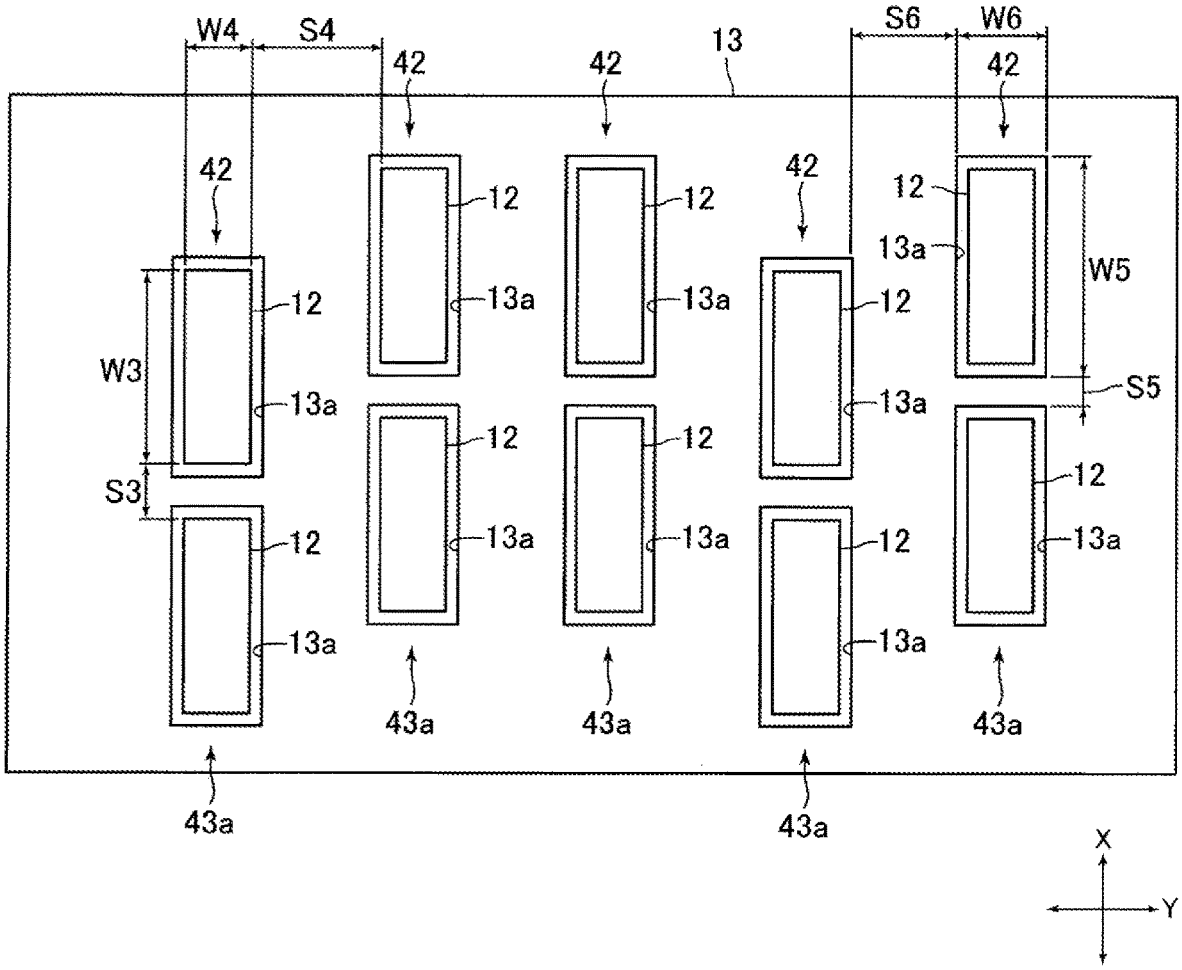
FIG. 3 is a plan view for explaining a configuration of an ink receiving portion and a fixed-side cover of the maintenance unit shown in FIG. 1.
Figure 4:
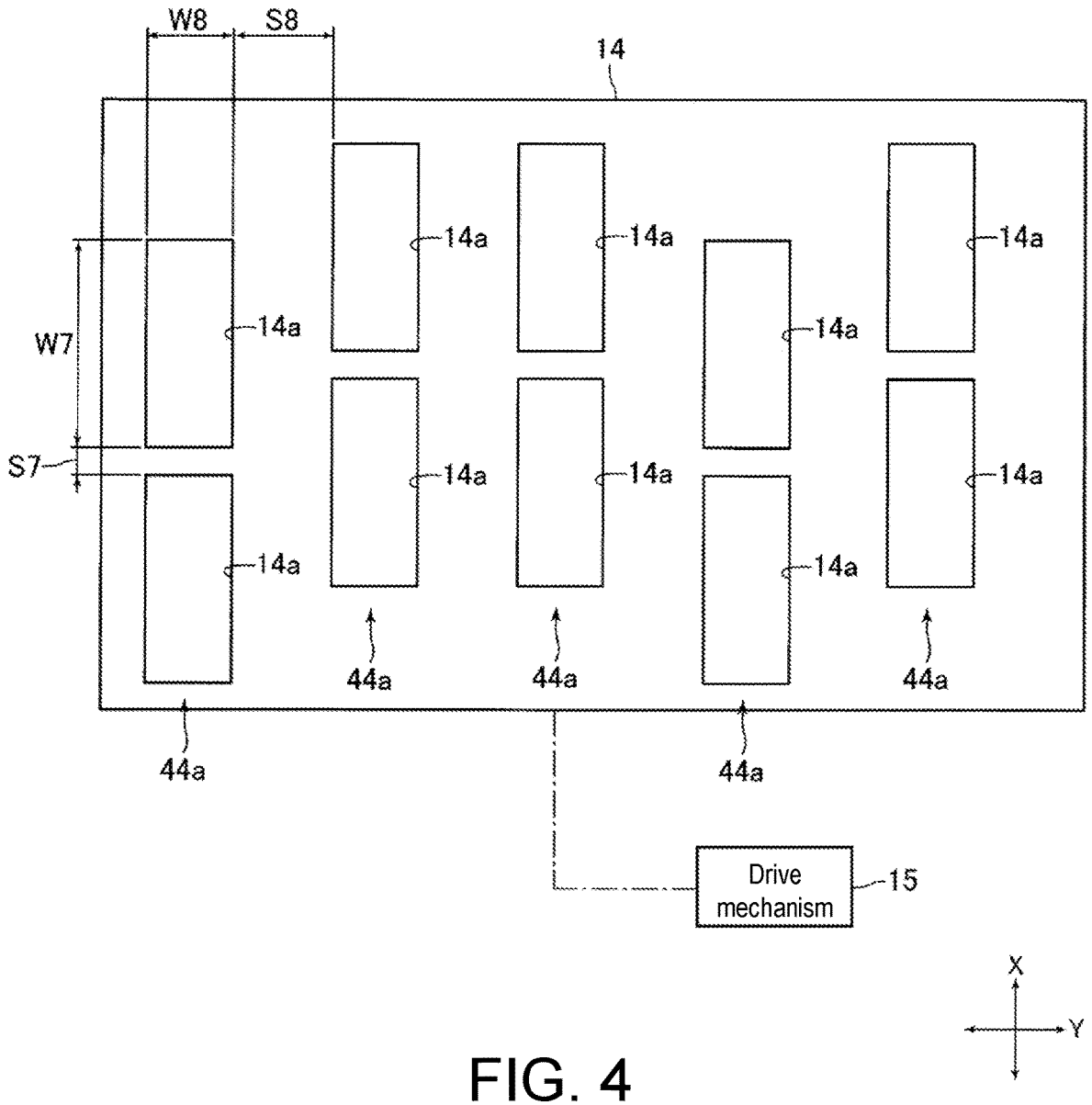
FIG. 4 is a plan view for explaining a configuration of a movable-side cover of the maintenance unit shown in FIG. 1.
Figure 5A:
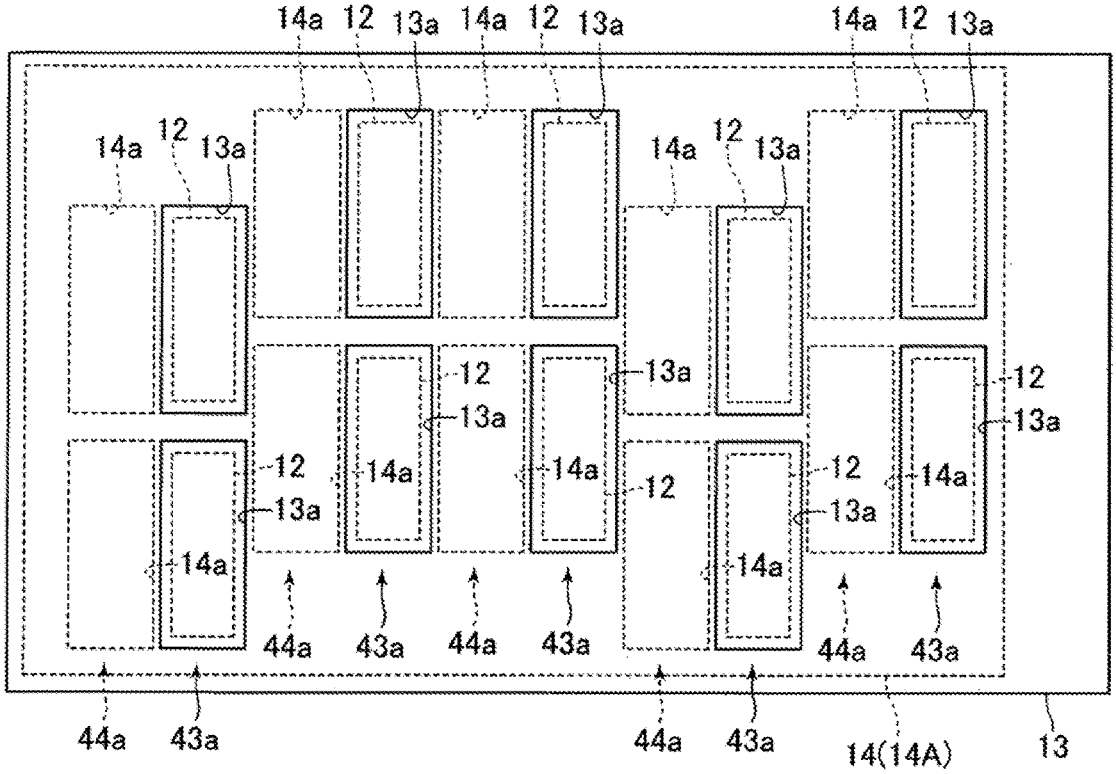
FIGS. 5A and 5B are plan views for explaining the operation of the movable-side cover shown in FIG. 4.
Figure 5B:
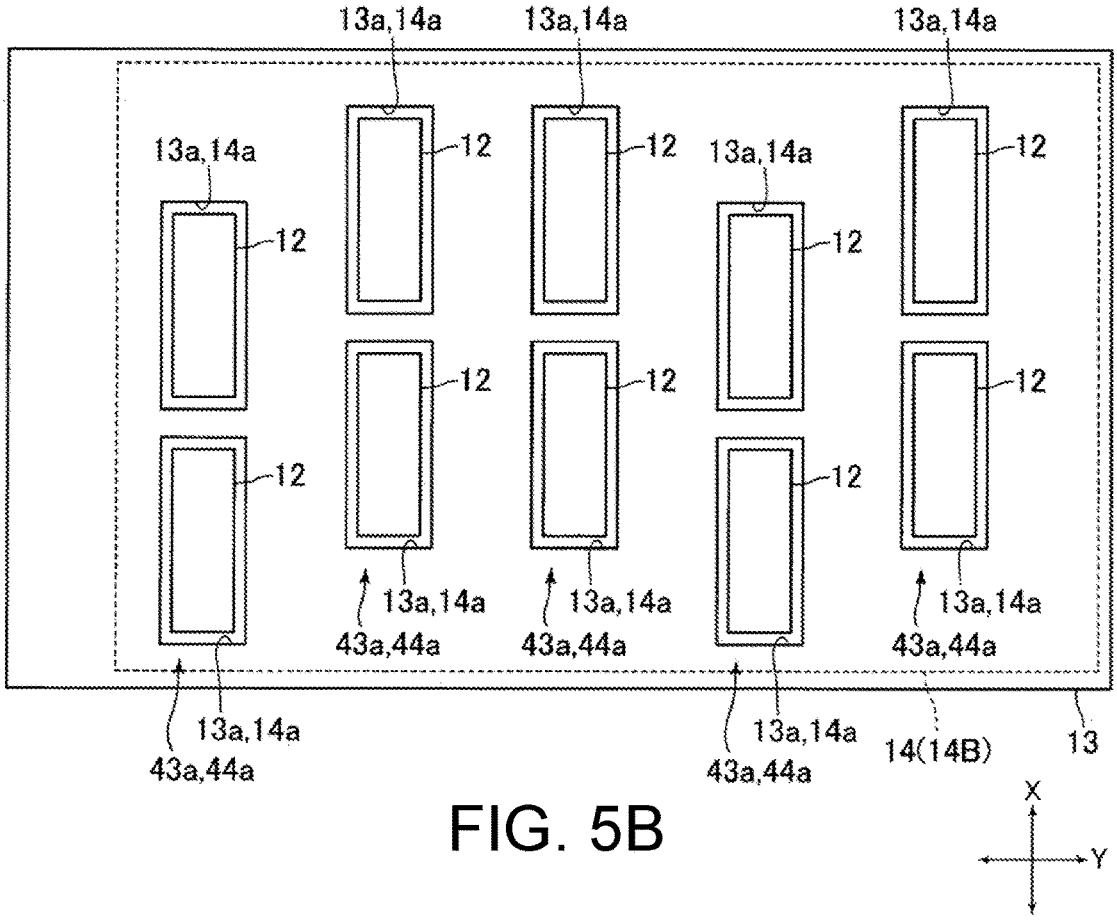

FIG. 3 is a plan view for explaining the configuration of a cap body 12 and a fixed-side cover 13 of the maintenance unit 11 shown in FIG. 1. FIG. 4 is a plan view for explaining the configuration of a movable-side cover 14 of the maintenance unit 11 shown in FIG. 1. FIGS. 5A and 5B are plan views for explaining the operation of the movable-side cover 14 shown in FIG. 4.

The maintenance unit 11 includes a capping mechanism that covers the nozzle surface 3*a* and suctions ink from the nozzles. The capping mechanism includes a plurality of cap bodies 12 that cover the nozzle surface 3*a* from the lower side. Specifically, the capping mechanism includes the same number of cap bodies 12 as the heads 3 mounted on the carriage 4. In other words, the capping mechanism includes ten cap bodies 12.

In addition, the maintenance unit 11 includes the fixed-side cover 13 disposed on the upper side of the ten cap bodies 12 to cover the upper surface side of the ten cap bodies 12, and the movable-side cover 14 disposed in a state of overlapping the fixed-side cover 13 on the upper side of the ten cap bodies 12 to cover the upper surface side of the ten cap bodies 12. The movable-side cover 14 is slidable with respect to the fixed-side cover 13. The maintenance unit 11 includes a moving mechanism 15 that slides the movable-side cover 14 with respect to the fixed-side cover 13.

The cap body 12 includes, for example, a rubber cap made of rubber and a liquid landing member disposed on the upper side of the rubber cap. One end of an ink discharge pipe is connected to the bottom surface of the cap body 12, and the other end of the ink discharge pipe is connected to a waste ink tank. A suction pump is disposed in the middle of the ink discharge pipe. When ink is suctioned from the nozzles of the head 3, the end portion of the rubber cap is in close contact with the lower surface of the head 3, and the suction pump is driven with the rubber cap covering the nozzle surface 3*a* from the lower side. The cap body 12 of the present embodiment is an ink receiving portion for receiving the ink suctioned by the suction pump and flowing out from the nozzles of the head 3 on the lower side of the nozzle surface 3*a*.

The shape of the cap body 12 when viewed from the upper side is a rectangular shape. One side of the rectangular cap body 12 is parallel to the left-right direction. That is, the direction parallel to one side of the rectangular cap body 12 is the left-right direction. Specifically, the short side of the rectangular cap body 12 is parallel to the left-right direction. That is, the direction parallel to the short side of the rectangular cap body 12 is the left-right direction. The width of the cap body 12 in the front-back direction (length of the long side of the rectangular cap body 12) W3 is slightly wider than the width W1 of the nozzle surface 3*a* in the front-back direction. The width in the left-right direction of the cap body 12 (length of the short side of the rectangular cap body 12) W4 is slightly wider than the width W2 in the left-right direction of the nozzle surface 3*a*.

As described above, the capping mechanism includes ten cap bodies 12. The ten cap bodies 12 are arranged at positions corresponding to the ten heads 3 mounted on the carriage 4. That is, as shown in FIG. 3, the two cap bodies 12, that are arranged at a constant interval in the front-back direction and at the same position in the left-right direction, are arranged at five locations at a constant interval in the left-right direction. When two cap bodies 12 arranged at the same position in the left-right direction are defined as a cap body set 42, the interval S3 between the two cap bodies 12 configuring the cap body set 42 in the front-back direction is narrower than the width W3 in the front-back direction of the cap body 12. An interval S4 in the left-right direction of the five cap body sets 42 is wider than a width W4 in the left-right direction of the cap body 12.

Thus, in the present embodiment, the two cap bodies 12 arranged in a state of being spaced apart by the interval S3 narrower than the width W3 in the front-back direction of the cap body 12 in the front-back direction are arranged at five locations in a state of being spaced apart by the interval S4 wider than the width W4 in the left-right direction of the cap body 12 in the left-right direction. Furthermore, in the present embodiment, the ten cap bodies 12 are arranged in a state of being spaced apart by the interval S4 wider than the width W4 in the left-right direction of the cap body 12 in the left-right direction.

Three of the five cap body sets 42 are arranged at the same position in the front-back direction. The remaining two cap body sets 42 are arranged at the same position in the front-back direction and are arranged at positions shifted from the three cap body sets 42. The amount of misalignment in the front-back direction between the three cap body sets 42 disposed at the same position in the front-back direction and the remaining two cap body sets 42 disposed at the same position in the front-back direction is smaller than the width W3 in the front-back direction of the cap body 12.

The fixed-side cover 13 is formed in a flat plate shape. The fixed-side cover 13 is disposed so that the thickness direction of the fixed-side cover 13 and the vertical direction coincide. The fixed-side cover 13 is formed with ten first openings 13*a* that penetrate the fixed-side cover 13 in the vertical direction and are disposed on the upper side of each of the ten cap bodies 12. That is, as shown in FIG. 3, in the fixed-side cover 13, two first openings 13*a* that are arranged at a constant interval in the front-back direction and arranged at the same position in the left-right direction are formed at five locations at a constant interval in the left-right direction.

The first opening 13*a* is formed in a rectangular shape. The short side of the first opening 13*a* formed in a rectangular shape is arranged in parallel to the left-right direction. When two first openings 13*a* arranged at the same position in the left-right direction are referred to as a first opening set 43*a*, an interval S5 in the front-back direction of the two first openings 13*a* configuring the first opening set 43*a* Is narrower than the width W5 of the first opening 13*a* in the front-back direction (length of the long side of the first opening 13*a*). An interval S6 in the left-right direction of the five first opening sets 43*a* is wider than the width W6 in the left-right direction of the first opening 13*a* (length of the short side of the first opening 13*a*).

The first opening 13*a* is formed to a size the entire cap body 12 is exposed when viewed from the upper side. That is, the width W5 in the front-back direction of the first opening 13*a* is wider than the width W3 in the front-back direction of the cap body 12, and the width W6 in the left-right direction of the first opening 13*a* is wider than the width W4 in the left-right direction of the cap body 12. When viewed from the upper side, the respective centers of the ten first openings 13*a* coincide with the respective centers of the ten cap bodies 12. Furthermore, for example, when viewed from the upper side, the first opening 13*a* has a similar shape to the cap body 12.

The movable-side cover 14 is formed in a flat plate shape. The movable-side cover 14 is arranged so that the thickness direction of the movable-side cover 14 and the vertical direction coincide. The movable-side cover 14 is disposed on the lower side of the fixed-side cover 13. The movable-side cover 14 is slidable in the left-right direction. The movable-side cover 14 may be disposed on the upper side of the fixed-side cover 13.

The movable-side cover 14 is formed with ten second openings 14*a* that penetrate the movable-side cover 14 in the vertical direction and can be disposed on the upper side of each of the ten cap bodies 12. That is, as shown in FIG. 4, in the movable-side cover 14, two second openings 14*a* that are arranged at a constant interval in the front-back direction and arranged at the same position in the left-right direction are formed at five locations at a constant interval in the left-right direction.

The second opening 14*a* is formed in a rectangular shape. The short side of the second opening 14*a* formed in a rectangular shape is arranged in parallel to the left-right direction. When the two second openings 14*a* arranged at the same position in the left-right direction are referred to as the second opening set 44*a*, an interval S7 in the front-back direction of the two second openings 14*a* configuring the second opening set 44*a* is narrower than the width W7 of the second opening 14*a* in the front-back direction (length of the long side of the second opening 14*a*). An interval S8 in the left-right direction of the five second opening sets 44*a* is wider than the width W8 in the left-right direction of the second opening 14*a* (length of the short side of the second opening 14*a*).

The second opening 14*a* is formed to a size the entire cap body 12 is exposed when viewed from the upper side in a state in which the second opening 14*a* is disposed on the upper side of the cap body 12. That is, the width W7 in the front-back direction of the second opening 14*a* is wider than the width W3 in the front-back direction of the cap body 12, and the width W8 in the left-right direction of the second opening 14*a* is wider than the width W4 in the left-right direction of the cap body 12. The movable-side cover 14 is slidable to a position where the centers of the ten second openings 14*a* coincide with the centers of the ten cap bodies 12 when viewed from the upper side.

The width W6 in the left-right direction of the first opening 13*a* is narrower than the interval S8 in the left-right direction of the second opening set 44*a*. That is, the width W6 in the left-right direction of the first opening 13*a* is narrower than the interval S8 in the left-right direction of the ten second openings 14*a*. The width W8 in the left-right direction of the second opening 14*a* is narrower than the interval S6 in the left-right direction of the first opening set 43*a*. That is, the width W8 in the left-right direction of the second opening 14*a* is narrower than the interval S6 in the left-right direction of the ten first openings 13*a*. In the present embodiment, the second opening 14*a* is formed to the same shape as the first opening 13*a*.

The moving mechanism 15 slides the movable-side cover 14 in the left-right direction. The moving mechanism 15 includes a motor and a power transmission mechanism that transmits the power of the motor to the movable-side cover 14. The power transmission mechanism includes, for example, a cam member that turns by the power of the motor. Alternatively, the power transmission mechanism includes, for example, a pinion that rotates with the power of the motor and a rack that meshes with the pinion. The power transmission mechanism may include a driving pulley that rotates with the power of the motor, a driven pulley, and a belt applied across the driving pulley and the driven pulley. Furthermore, the moving mechanism 15 may include a solenoid as a drive source instead of the motor.

The moving mechanism 15 slides the movable-side cover 14 in the left-right direction between a closed position 14A where each of the four second opening sets 44*a* of the five second opening sets 44*a* is disposed between each of the five first opening sets 43*a* and the movable-side cover 14 closes the ten first openings 13*a*, as shown in FIG. 5A, and an open position 14B where the first opening set 43*a* and the second opening set 44*a* adjacent in the left-right direction at the closed position 14A are overlapped in the vertical direction and the ten cap bodies 12 are entirely exposed when viewed from the upper side, as shown in FIG. 5B.

That is, the moving mechanism 15 slides the movable-side cover 14 in the left-right direction between a closed position 14A where eight second openings 14*a* are disposed between the ten first openings 13*a* in the left-right direction and the movable-side cover 14 closes the ten first openings 13*a*, and an open position 14B where the first opening 13*a* and the second opening 14*a* adjacent in the left-right direction at the closed position 14A are overlapped in the vertical direction and the ten cap bodies 12 are entirely exposed when viewed from the upper side. When the movable-side cover 14 is in the open position 14B, the first opening 13*a* and the second opening 14*a* are completely overlapped.

In the present embodiment, when the carriage 4 is not disposed in the maintenance unit 11, the movable-side cover 14 is disposed at the closed position 14A, and the movable-side cover 14 closes the ten first openings 13*a*. That is, the upper surface side of the ten cap bodies 12 is covered with the fixed-side cover 13 and the movable-side cover 14. When the carriage 4 moves to the maintenance unit 11 and the cap body 12 covers the nozzle surface 3*a* from the lower side to suction ink from the nozzles of the head 3 by the capping mechanism, the movable-side cover 14 is moved from the closed position 14A to the open position 14B and the entire ten cap bodies 12 are exposed when viewed from the upper side.

Main Effect of the Present Embodiment

As described above, in the present embodiment, the maintenance unit 11 includes the fixed-side cover 13 formed with ten first openings 13*a* disposed on the upper side of each of the ten cap bodies 12, and the movable-side cover 14 formed with ten second openings 14*a* that can be disposed on the upper sides of each of the ten cap bodies 12. Furthermore, in the present embodiment, the moving mechanism 15 slides the movable-side cover 14 in the left-right direction between a closed position 14A where four second opening sets 44*a* of the five second opening sets 44*a* are disposed between the five first opening sets 43*a* and the movable-side cover 14 closes the ten first openings 13*a*, and an open position 14B where the first opening set 43*a* and the second opening set 44*a* adjacent in the left-right direction at the closed position 14A are overlapped in the vertical direction and the entire ten cap bodies 12 are exposed when viewed from the upper side.

That is, in the present embodiment, the upper side of the cap body 12 covered by the movable-side cover 14 is opened by sliding the movable-side cover 14 to one side in the left-right direction up to a position where the first opening set 43*a* and the second opening set 44*a* adjacent in the left-right direction at the closed position 14A overlap in the vertical direction. Therefore, in the present embodiment, even if the upper surface side of the cap body 12 can be covered with the fixed-side cover 13 and the movable-side cover 14, the moving distance of the movable-side cover 14 when opening the upper side of the cap body 12 can be shortened.

In particular, in the present embodiment, since the upper side of the cap body 12 covered by the movable-side cover 14 is opened by moving the movable-side cover 14 at the closed position 14A to the open position 14B toward one side in the left-right direction, which is a direction parallel to the short side of the second opening 14*a* formed in a rectangular shape, the moving distance of the movable-side cover 14 when opening the upper side of the cap body 12 can be further shortened.

In the present embodiment, the moving mechanism 15 slides the movable-side cover 14 in the left-right direction (main scanning direction). Therefore, in the present embodiment, the maintenance unit 11 can be downsized in the front-back direction (sub scanning direction). Furthermore, in the present embodiment, since the fixed-side cover 13 and the movable-side cover 14 are formed in a flat plate shape, the configuration of the fixed-side cover 13 and the movable-side cover 14 can be simplified, and the maintenance unit 11 can be thinned in the vertical direction.

In the present embodiment, the width W6 in the left-right direction of the first opening 13*a* is narrower than the interval S8 in the left-right direction of the five second opening sets 44*a*. Therefore, in the present embodiment, when the movable-side cover 14 is disposed at the closed position 14A, the ten first openings 13*a* can be reliably closed by the movable-side cover 14.

Other Embodiments

The embodiment described above is an example of a preferred embodiment of the present disclosure, but the present disclosure is not limited thereto, and various modified examples can be made without changing the gist of the present disclosure.

In the embodiment described above, if the entire ten cap bodies 12 are exposed when the movable-side cover 14 is at the open position 14B, the first opening 13*a* and the second opening 14*a* may not be completely overlapped when the movable-side cover 14 is at the open position 14B. In the embodiment described above, the width W6 in the left-right direction of the first opening 13*a* may be equal to an interval S8 in the left-right direction of the second opening 14*a*. Furthermore, the width W8 in the left-right direction of the second opening 14*a* may be equal to the interval S6 in the left-right direction of the first opening 13*a*. Moreover, when the width W6 is equal to the interval S8 and the width W8 is equal to the interval S6, the interval S4 in the left-right direction of the cap body set 42 may be equal to the width W4 in the left-right direction of the cap body 12. In this case, the width W4, the width W6, and the width W8 are equal. In the embodiment described above, the second opening 14*a* may be formed smaller than the first opening 13*a* or may be formed larger than the first opening 13*a*.

In the embodiment described above, the number of heads 3 to be mounted on the carriage 4 may be a plurality of nine or less, or eleven or more. In this case, the maintenance unit 11 includes a plurality of cap bodies 12 corresponding to the number of heads 3 mounted on the carriage 4. Furthermore, in this case, the first opening 13*a* and the second opening 14*a* corresponding to the number of cap bodies 12 are formed in the fixed-side cover 13 and the movable-side cover 14, respectively. Moreover, in the embodiment described above, a plurality of head sets 33 of four or less may be arranged at a constant interval S2 in the left-right direction, or six or more head sets 33 may be arranged at a constant interval S2 in the left-right direction. In this case, the cap body sets 42 corresponding to the number of the head sets 33 are arranged at a constant interval S4 in the left-right direction.

In the embodiment described above, the head set 33 may be formed by three or more heads 3. In this case, the cap body set 42 is formed by three or more cap bodies 12 corresponding to the number of the heads 3 forming the head set 33. Furthermore, in the embodiment described above, there may be a head set 33 in which the number of the heads 3 forming the head set 33 is different from the other head sets 33, or one head 3 may be disposed instead of several head sets 33.

In the embodiment described above, all of the plurality of heads 3 may be arranged at a constant interval S2 is left in the left-right direction. In this case, all of the plurality of cap bodies 12 are arranged at a constant interval S4 is left in the left-right direction. When the number of the heads 3 mounted on the carriage 4 is two, the two heads 3 are arranged at a constant interval S2 in the left-right direction, and the two cap bodies 12 are arranged at a constant interval S4 in the left-right direction.

In the embodiment described above, the interval S1 in the front-back direction of the head 3 may be wider than the width W1 in the front-back direction of the nozzle surface 3*a*. In this case, the interval S3 in the front-back direction of the cap body 12 is greater than or equal to the width W3 in the front-back direction of the cap body 12, the interval S5 in the front-back direction of the first opening 13*a* is greater than or equal to the width W5 in the front-back direction of the first opening 13*a*, and the interval S7 in the front-back direction of the second opening 14*a* is greater than or equal to the width W7 in the front-back direction of the second opening 14*a*.

In this case, the moving mechanism 15 may slide the movable-side cover 14 in the front-back direction (sub scanning direction). Specifically, the moving mechanism 15 may, for example, slide the movable-side cover 14 in the front-back direction between a closed position where the second openings 14*a* disposed on one side in the front-back direction of the two second openings 14*a* forming the second opening set 44*a* is arranged between the two first openings 13*a* forming the first opening set 43*a* in the front-back direction and the movable-side cover 14 closes the ten first openings 13*a*, and an open position where the first opening 13*a* and the second opening 14*a* adjacent in the front-back direction at the closed position are overlapped in the vertical direction and the entire ten cap bodies 12 are exposed when viewed from the upper side.

In this case, the front-back direction (X direction) is the first direction. Furthermore, in this case, the interval S4 in the left-right direction of the cap body set 42 may be smaller than the width W4 in the left-right direction of the cap body 12, the interval S6 in the left-right direction of the first opening set 43*a* may be narrower than the width W6 in the left-right direction of the first opening 13*a*, and the interval S8 in the left-right direction of the second opening set 44*a* may be narrower than the width W8 in the left-right direction of the second opening 14*a*.

In the embodiment described above, the head 3 may be mounted on the carriage 4 so that the short side of the nozzle surface 3*a* is parallel to the direction inclined with respect to the front-back direction and the left-right direction. Even in this case, the short side of the cap body 12 is parallel to the short side of the nozzle surface 3*a*. In this case, for example, the moving mechanism 15 slides the movable-side cover 14 in a direction parallel to the short side of the cap body 12. In this case, the direction parallel to the short side of the cap body 12 is the first direction.

Figure 6A:
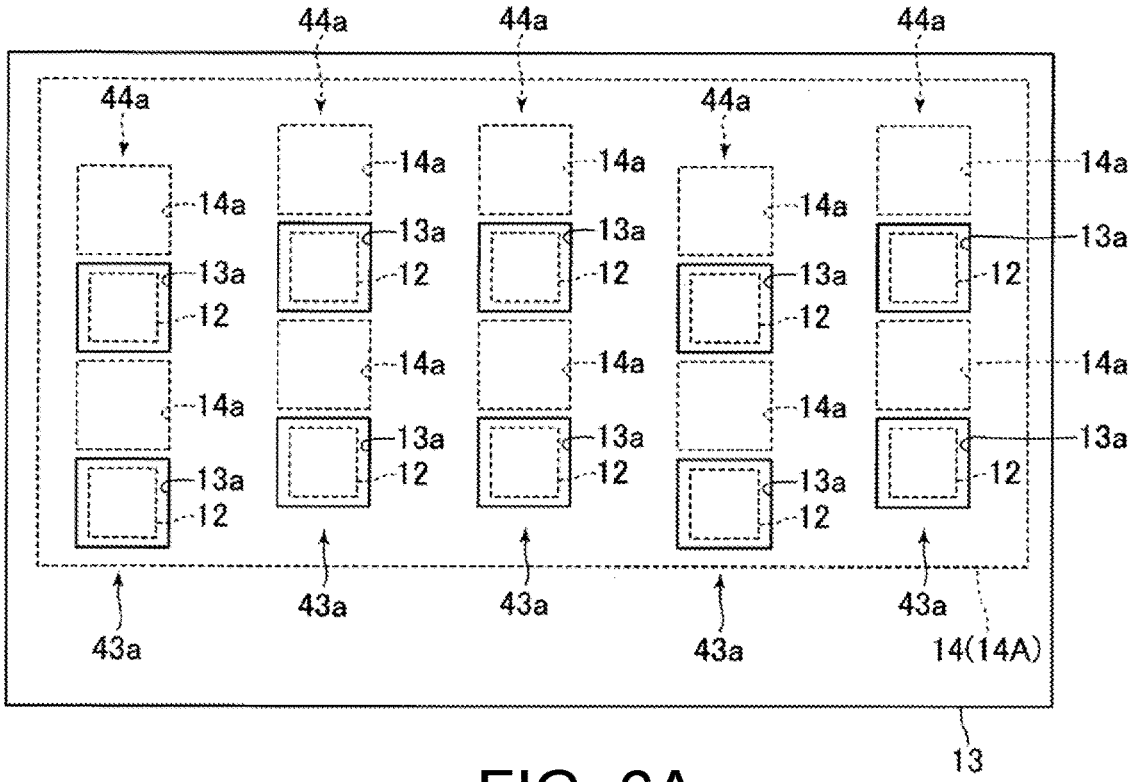
FIGS. 6A and 6B are plan views for explaining the configuration of an ink receiving portion, a fixed-side cover and a movable-side cover according to another embodiment of the present disclosure, and the operation of the movable-side cover.
Figure 6B:
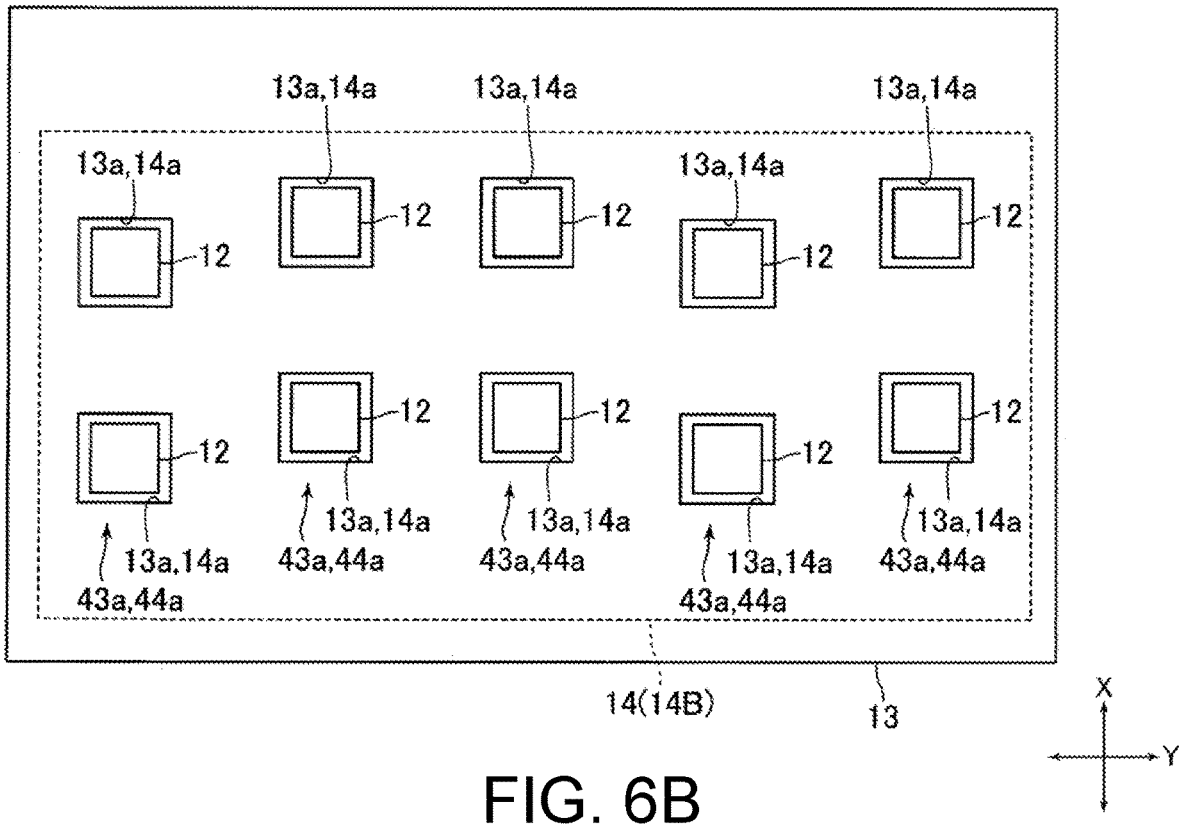

In the embodiment described above, the nozzle surface 3*a* may be formed in a square shape, and the head 3 may be mounted on the carriage 4 so that one side of the nozzle surface 3*a* is parallel to the front-back direction. In this case, for example, as shown in FIGS. 6A and 6B, the shape of the cap body 12 when viewed from the upper side is a square shape. For example, the first opening 13*a* and the second opening 14*a* are formed in a square shape.

When the shape of the cap body 12 when viewed from the upper side is a square shape, for example, the interval S4 in the left-right direction of the cap body set 42 is greater than or equal to the width W4 in the left-right direction of the cap body 12, the interval S6 in the left-right direction of the first opening set 43*a* is greater than or equal to the width W6 in the left-right direction of the first opening 13*a*, and the interval S8 in the left-right direction of the second opening set 44*a* is greater than or equal to the width W8 in the left-right direction of the second opening 14*a*, the moving mechanism 15 slides the movable-side cover 14 in the left-right direction, as in the embodiment described above.

Specifically, the moving mechanism 15 slides the movable-side cover 14 in the left-right direction between a closed position 14A where each of the four second opening sets 44*a* of the five second opening sets 44*a* are disposed between the five first opening sets 43*a* and the movable-side cover 14 closes the ten first openings 13*a*, and an open position 14B where the first opening set 43*a* and the second opening set 44*a* adjacent in the left-right direction at the closed position 14A are overlapped in the vertical direction and the entire ten cap bodies 12 are exposed when viewed from the upper side.

Furthermore, when the shape of the cap body 12 when viewed from the upper side is a square shape, for example, as shown in FIGS. 6A and 6B, the interval S3 in the front-back direction of the cap body 12 is greater than or equal to the width W3 in the front-back direction of the cap body 12, the interval S5 in the front-back direction of the first opening 13*a* is greater than or equal to the width W5 in the front-back direction of the first opening 13*a*, and the interval S7 in the front-back direction of the second opening 14*a* is greater than or equal to the width W7 in the front-back direction of the second opening 14*a*, the moving mechanism 15 may slide the movable-side cover 14 in the front-back direction.

Specifically, the moving mechanism 15 may slide the movable-side cover 14 in the front-back direction between a closed position 14A (see FIG. 6A) where the second openings 14*a* disposed on one side in the front-back direction of the two second openings 14*a* forming the second opening set 44*a* is arranged between the two first openings 13*a* forming the first opening set 43*a* in the front-back direction and the movable-side cover 14 closes the ten first openings 13*a*, and an open position 14B (see FIG. 6B) where the first opening 13*a* and the second opening 14*a* adjacent in the front-back direction at the closed position 14A are overlapped in the vertical direction and the entire ten cap bodies 12 are exposed when viewed from the upper side. In this case, the front-back direction (X direction) is the first direction.

In the embodiment described above, the nozzle surface 3*a* may be formed in a shape other than a rectangular shape and a square shape. In this case, the cap body 12, the first opening 13*a*, and the second opening 14*a* are formed in a shape corresponding to the shape of the nozzle surface 3*a*. Furthermore, in the embodiment described above, the fixed-side cover 13 may not be formed in a flat plate shape, and the movable-side cover 14 may not be formed in a flat plate shape. For example, the fixed-side cover 13 and the movable-side cover 14 may be formed in a block shape.

In the embodiment described above, the cap body 12 covering the nozzle surface 3*a* from the lower side serves as an ink receiving portion for receiving the ink flowing out from the nozzles of the head 3 at the lower side of the nozzle surface 3*a*, but when purging and flushing of the head 3 are performed in the maintenance unit 11, the ink receiving member for receiving the ink forcibly ejected from the nozzles of the head 3 and flowed out may serve as the ink receiving portion for receiving the ink flowing out from the nozzles of the head 3 at the lower side of the nozzle surface 3*a*.

What is claimed is:

1. A maintenance unit provided to prevent clogging of nozzles of an inkjet head, the maintenance unit comprising:

a plurality of ink receiving portions for receiving ink flowing out from the nozzles on a lower side of a nozzle surface of the inkjet head in which a plurality of the nozzles is arranged;

a fixed-side cover, disposed on an upper side of the plurality of ink receiving portions to cover an upper surface side of the plurality of ink receiving portions;

a movable-side cover, disposed in a state of overlapping the fixed-side cover on the upper side of the plurality of ink receiving portions to cover the upper surface side of the plurality of ink receiving portions and disposed to be slidable with respect to the fixed-side cover; and a moving mechanism that slides the movable-side cover with respect to the fixed-side cover, wherein one direction in a horizontal direction is set as a first direction, at least two of the ink receiving portions are arranged at an interval of greater than or equal to a width in the first direction of the ink receiving portion in the first direction, the fixed-side cover is provided with a plurality of first openings that penetrate the fixed-side cover in a vertical direction and are disposed on the upper sides of each of the plurality of ink receiving portions, the movable-side cover is provided with a plurality of second openings that penetrate the movable-side cover in the vertical direction and is capable of being disposed on the upper side of each of the plurality of ink receiving portions, at least one first opening is provided with a size that an entirety of a corresponding ink receiving portion is exposed when viewed from the upper side, at least one second opening is provided with a size that an entirety of the corresponding ink receiving portion is exposed when viewed from the upper side in a state where the at least one second opening is disposed on the upper side of the corresponding ink receiving portion, a width in the first direction of the at least one second opening is less than or equal to the interval in the first direction of the plurality of first openings, a width in the first direction of the at least one first opening is less than or equal to the interval in the first direction of the plurality of second openings, and the moving mechanism slides the movable-side cover in the first direction between a closed position and an open position, wherein the closed position is a position where at least one of the second opening is disposed between the plurality of first openings in the first direction and the movable-side cover closes the plurality of first openings, and the open position is a position where the at least one first opening and the at least one second opening adjacent in the first direction at the closed position are overlapped in the vertical direction and an entirety of the plurality of ink receiving portions are exposed when viewed from the upper side.

2. The maintenance unit according to claim 1, wherein a shape of the corresponding ink receiving portion when viewed from the upper side is a rectangular shape or a square shape, and a direction parallel to one side of the corresponding ink receiving portion having a rectangular shape or a square shape is the first direction.

3. The maintenance unit according to claim 2, wherein a shape of the corresponding ink receiving portion when viewed from the upper side is a rectangular shape, and a direction parallel to a short side of the corresponding ink receiving portion having a rectangular shape is the first direction.

4. The maintenance unit according to claim 3, wherein the at least one first opening and the at least one second opening are provided in a rectangular shape, and a short side of the at least one first opening provided in a rectangular shape and a short side of the at least one second opening provided in a rectangular shape are disposed to be parallel to the first direction.

5. The maintenance unit according to claim 1, wherein the fixed-side cover and the movable-side cover are provided in a flat plate shape.

6. The maintenance unit according to claim 2, wherein the fixed-side cover and the movable-side cover are provided in a flat plate shape.

7. The maintenance unit according to claim 3, wherein the fixed-side cover and the movable-side cover are provided in a flat plate shape.

8. The maintenance unit according to claim 4, wherein the fixed-side cover and the movable-side cover are provided in a flat plate shape.

9. The maintenance unit according to claim 1, wherein a direction orthogonal to the vertical direction and the first direction is set as a second direction, at least two of the ink receiving portions are disposed at an interval narrower than a width in the second direction of the ink receiving portion in the second direction and disposed at the same position in the first direction, the least two of the ink receiving portions are disposed at at least two locations at an interval of greater than or equal to the width in the first direction of the ink receiving portion in the first direction.

10. The maintenance unit according to claim 2, wherein a direction orthogonal to the vertical direction and the first direction is set as a second direction, at least two of the ink receiving portions are disposed at an interval narrower than a width in the second direction of the ink receiving portion in the second direction and disposed at the same position in the first direction, the least two of the ink receiving portions are disposed at at least two locations at an interval of greater than or equal to the width in the first direction of the ink receiving portion in the first direction.

11. The maintenance unit according to claim 3, wherein a direction orthogonal to the vertical direction and the first direction is set as a second direction, at least two of the ink receiving portions are disposed at an interval narrower than a width in the second direction of the ink receiving portion in the second direction and disposed at the same position in the first direction, the least two of the ink receiving portions are disposed at at least two locations at an interval of greater than or equal to the width in the first direction of the ink receiving portion in the first direction.

12. The maintenance unit according to claim 4, wherein a direction orthogonal to the vertical direction and the first direction is set as a second direction, at least two of the ink receiving portions are disposed at an interval narrower than a width in the second direction of the ink receiving portion in the second direction and disposed at the same position in the first direction, the least two of the ink receiving portions are disposed at at least two locations at an interval of greater than or equal to the width in the first direction of the ink receiving portion in the first direction.

13. The maintenance unit according to claim 5, wherein a direction orthogonal to the vertical direction and the first direction is set as a second direction, at least two of the ink receiving portions are disposed at an interval narrower than a width in the second direction of the ink receiving portion in the second direction and disposed at the same position in the first direction, the least two of the ink receiving portions are disposed at at least two locations at an interval of greater than or equal to the width in the first direction of the ink receiving portion in the first direction.

14. An inkjet printer comprising:

the maintenance unit according to claim 1, a plurality of the inkjet heads that eject ink droplets, a carriage on which the plurality of inkjet heads is mounted, and a carriage moving mechanism that moves the carriage in a main scanning direction.

15. The inkjet printer according to claim 14, wherein the moving mechanism slides the movable-side cover in the main scanning direction.

* * * * *